US005767805A

United States Patent [19]

Aubry

[11] Patent Number: 5,767,805

[45] Date of Patent: Jun. 16, 1998

[54] METHOD FOR THE BROADENING OF A VOLUME ANTENNA BEAM

[75] Inventor: Claude Aubry, Grigny, France

[73] Assignee: Thomson-CSF, Paris, France

[21] Appl. No.: 703,216

[22] Filed: Aug. 26, 1996

[30] Foreign Application Priority Data

Aug. 29, 1995 [FR] France ..... 95 10167

[51] Int. Cl.[6] ..... H01Q 3/24

[52] U.S. Cl. ..... 342/372; 342/154; 343/891

[58] Field of Search ..... 342/154, 157, 342/372; 343/844, 891

[56] References Cited

U.S. PATENT DOCUMENTS

| | | | |
|---|---|---|---|
| H173 | 12/1986 | Claborn et al. | 342/372 |
| 3,797,020 | 3/1974 | Roger et al. . | |
| 4,500,882 | 2/1985 | Katagi et al. | 342/372 |
| 5,047,785 | 9/1991 | Julian | 342/372 |

*Primary Examiner*—Thomas H. Tarcza
*Assistant Examiner*—Dao L. Phan
*Attorney, Agent, or Firm*—Oblon, Spivak, McClelland, Maier & Neustadt, P.C.

[57] ABSTRACT

The disclosure relates to electronic scanning array antennas whose radiating elements are distributed within a volume instead of being distributed on a reflective surface that is plane or generated by revolution. It pertains to a method for broadening the beam of a volume antenna aimed in a direction without giving it asymmetrical deformation or substantially increasing the secondary lobes. This method consists of applying the following phase excitation law to the radiating elements of the volume antenna:

$$\frac{2\pi}{\lambda}\rho_n + 2k\pi$$

where $\lambda$ is the wavelength of the radiation transmitted or received and $\rho_n$ is the distance from the radiating element with an index n considered to a point I external to the volume antenna located on the axis of aiming direction on the side opposite the aiming direction.

2 Claims, 2 Drawing Sheets

METHOD FOR THE BROADENING OF A VOLUME ANTENNA BEAM

BACKGROUND OF THE INVENTION

1. Field of the Invention

The present invention relates to volume or "steric" antennas, namely electronic scanning array antennas whose radiating elements are distributed within a volume instead of being distributed on a reflective surface that is plane or generated by revolution.

This type of antenna has the advantage of enabling 3D coverage, most usually hemispherical or quasi-hemispherical, in which all the radiating elements participate. This is not the case with array antennas distributed on a reflective surface which either, if they are plane, require several panels oriented differently with only one panel being used at a time or, if they are cylindrical or spherical, bring into play only the radiating elements that are visible from the direction aimed at. Owing to this property, greater performance characteristics in terms of gain and directivity are expected of volume antennas. This is why they have been studied for a long time.

With volume antennas, as with other types of array antennas, it may be useful to broaden the main lobe of the radiation pattern at transmission without giving it asymmetrical deformation or substantially increasing the secondary lobes. This is particularly the case in radar technology when it is desired to increase the watch domain but it may be useful in other circumstances in other techniques such as those of radio-communications or radio-astronomy.

2. Description of the Prior Art

The presently known techniques used to broaden the beam radiated by an array antenna relate only to conventional linear or plane antenna arrays. In the case of a standard linear antenna array fed according to a law of amplitude that is symmetrical and decreasing from the center, the broadening method that, in most cases, proves to be the most effective method consists of the application, to the array, of a quadratic phase variation law added to the aiming phase variation law. Indeed, it is known that the radiation pattern or field radiated at great distance by a set of elementary antennas equivalent to a radiating plane aperture can be expressed on the basis of the illumination law or field distribution of the set of elementary antennas by means of a Fourier transform. Now, if a law of excitation in amplitude is adopted that is symmetrical and decreasing from the center of the array, for example a truncated Gaussian law having the following form:

$$e^{-\alpha x^2} \quad x \leqq L/2$$

where $\alpha$ is a positive real number, L the length of the linear array of antennas and x the abscissa value along the array with a point of origin at the center of the array and a quadratic variation phase excitation law having the form $-\beta x^2$ where $\beta$ is a real number, a law of illumination is obtained in:

$$e^{-(\alpha+i\beta)x^2}$$

which is a Gaussian function with complex coefficients having the property of being the eigen function of the Fourier transform:

$$e^{-(\alpha+i\beta)x^2} \xrightarrow{TF} \sqrt{\frac{\pi}{\alpha+i\beta}} \times e^{-\frac{\mu^2}{4(\alpha+i\beta)}}$$

u being the variable representing the radiation direction.

Expressed in terms of antennas, this property means that the radiation pattern of a Gaussian field distribution is also Gaussian at least with respect to the main lobe. Since the width of the lobe is related to the modulus of the term $(\alpha+i\beta)$, it can be seen that the introduction of the quadratic phase law (term $\beta$) enables the broadening of the main lobe. For $\beta$ equals zero, we have the minimum nominal width and the greater the increase in $|\beta|$, the broader is the beam.

This method of broadening the beam of a linear array of elementary antennas can easily be extended to a plane array of elementary antennas by summing up the contributions of two quadratic variation phase excitation laws, one along the length x of the plane of the array with a coefficient $\beta_x$ and the other along the width y of the plane of the array with a coefficient $\beta_y$. On the contrary, there is nothing in principle that permits this method to be extended to a volume array of elementary antennas.

SUMMARY OF THE INVENTION

The present invention is aimed at broadening the beam of a volume array of elementary antennas without asymmetrical deformation of the beam or any major increase of the secondary lobes.

An object of the invention is a method for broadening the beam of a volume antenna by applying, to the radiating elements of the volume antenna, the following phase excitation law for each radiating element with an index n:

$$\frac{2\pi}{\lambda}\rho_n + 2k\pi$$

where $\lambda$ is the wavelength of the radiation transmitted or received and $\rho_n$ is the distance from the radiating element with an index n considered to a point I external to the volume antenna located on the axis of aiming direction on the side opposite the aiming direction.

BRIEF DESCRIPTION OF THE DRAWINGS

Other features and advantages of the invention shall appear from the following description of an exemplary embodiment. This description shall be made with reference to the drawings, of which.

MORE DETAILED DESCRIPTION

The property of a quadratic variation phase excitation law by which it broadens the directional beam of an elementary antenna linear array can be explained by the following fact: it converts the isophase surfaces of the waves transmitted or received, to which the aiming phase variation law gives the shape of planes oriented towards the aiming direction, into surfaces with an approximate shape of spherical sectors oriented towards the aiming direction. Indeed, let us take a linear array of radiating elements $A_1, A_2, \ldots, A_N$. If the aiming phase excitation law is disregarded, namely if a situation is assumed where there is an aiming direction perpendicular to the direction of the linear array, then the phase excitation law to be applied in order to give the transmitted waves isophase surfaces in the form of spherical sectors centered on a point I located on the axis normal to the array at its center 0, on the side opposite the aiming direction, must compensate for the differences in path existing between the point I assumed to be at the point of origin of the spherical waves and the different radiating elements of the array. For a radiating element located at the abscissa point x with respect to the center 0 of the array, the path difference d is equal to:

$$d = \sqrt{R^2 + x^2} - R$$

R being the distance between the center 0 of the array and the point I which is the center of the spherical sectors. The result thereof is a phase delay $\phi(x)$ equal to:

$$\phi(x) = \frac{2\pi}{\lambda}\left(\sqrt{R^2 + x^2} - R\right)$$

where $\lambda$ is the wavelength of the radiation transmitted or received.

To obtain wave surfaces in the shape of circular sectors, it is therefore necessary, in all strictness, to apply a phase excitation law $\phi_e(x)$ having the form:

$$\phi_e(x) = \frac{2\pi}{\lambda}\left(\sqrt{R^2 + x^2} - R\right) + \phi_0$$

where $\phi_0$ is any constant possibly taken to be equal to:

$$\frac{2\pi}{\lambda} R$$

so that, to obtain isophase wave surfaces in the form of circular sectors centered on a point I located on the axis normal to the array at its center, it is enough to apply a phase correction law to the radiating elements of the network giving each radiating element that has an abscissa value x with respect to the center 0 of the array a phase shift:

$$\frac{2\pi}{\lambda} \rho x$$

where $\rho_x$ is the distance from the radiating element considered with an abscissa value x to the point I.

However, if the distance R is great as compared to x, namely if the radiation aperture angle is not too great, the following can be written:

$$\sqrt{R^2 + x^2} = R\sqrt{1 + \frac{x^2}{R^2}} = R\sqrt{\left(1 + \frac{x^2}{2R}\right)^2 - \frac{x^4}{4R^2}} \approx R\left(1 + \frac{x^2}{2R}\right)$$

so that the phase excitation law $\phi_e(x)$ may be approximated by:

$$\phi_e(x) \cong \frac{2\pi}{\lambda} \times \frac{x^2}{2R} + \phi_0$$

Figure 1:
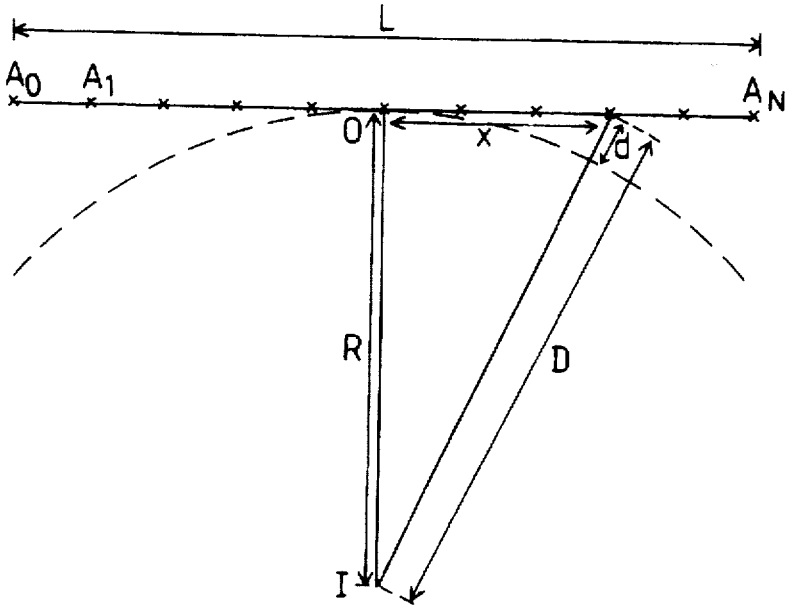
FIG. 1 is a drawing illustrating a physical interpretation of the beam broadening property of a linear array of elementary antennas due to the adoption of a quadratic variation phase excitation law.
Figure 2:
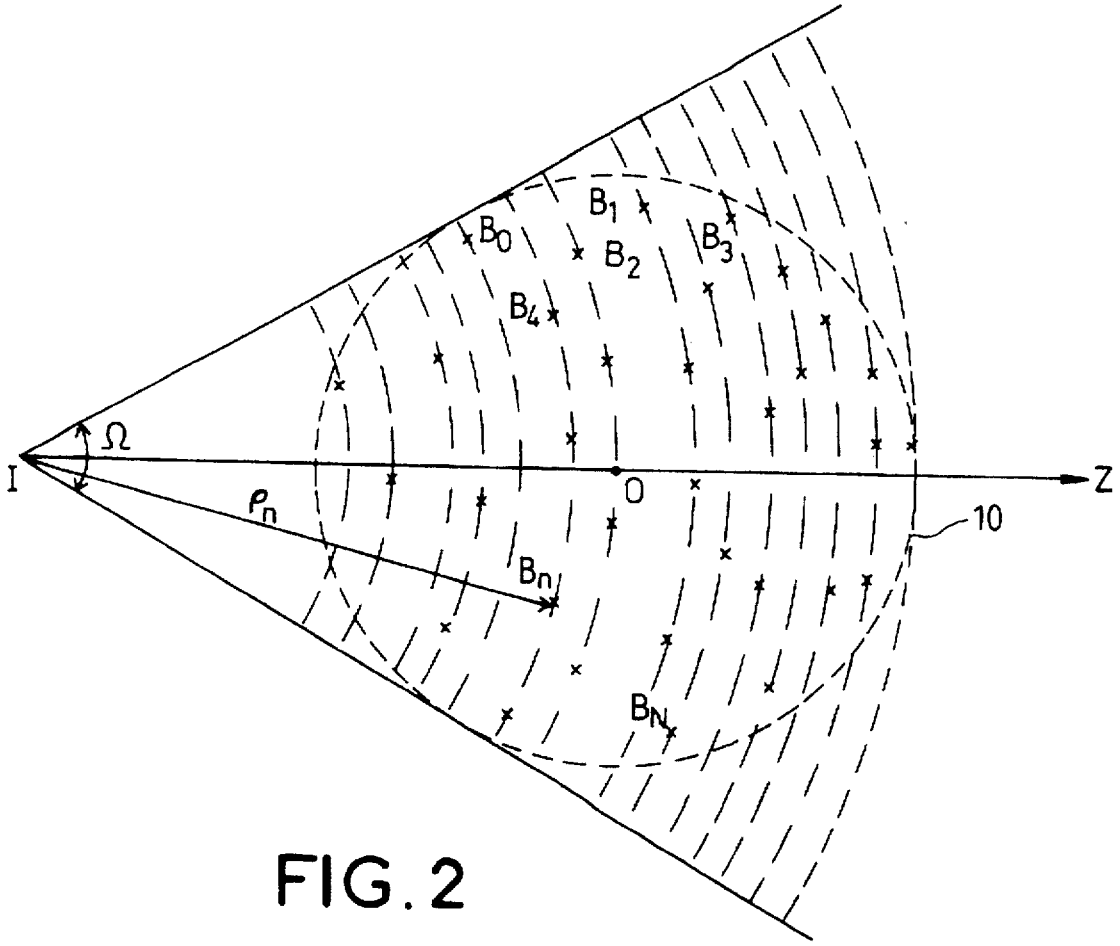
FIG. 2 is a diagram explaining the beam broadening method according to the invention on the basis of the physical interpretation of FIG. 1.

A quadratic variation phase excitation law is then recognized. Thus, for radiation aperture angles that are not too great, the divergence between a phase excitation law for the obtaining of a spherical wave and a quadratic variation phase excitation law may be overlooked. The result thereof is that it is possible to obtain a broadening of a beam with a phase excitation law for the obtaining of a spherical wave as well as with a quadratic variation phase excitation law, the former law having the advantage of being easily extended to volume arrays as can be seen in FIG. 2.

This figure shows an array of N radiating elements $B_1, B_2, \ldots, B_N$ distributed within a certain volume, in this case a ball 10 with a center 0. So as to avoid burdening this figure with anything that does not pertain to the invention proper, the figure does not show the feed lines of the radiating elements with their divider and their individual controlled phase-shifters. To each of the radiating elements, there is applied an aiming phase excitation law enabling the addition in phase of their contribution in an aiming direction OZ. This is the standard operation of focusing or collimation. In order to broaden the beam around the aiming direction, this focusing law is replaced by a phase law designed to give the waves transmitted in the aiming direction OZ, a spherical shape centered on a point I external to the array, located on the axis OZ of the aiming direction on the side opposite the aiming direction. From this point 1, there emanates a fictitious spherical wave imprisoned in the solid angle $\Omega$ at which the apparent contour of the array is seen. In this second phase excitation law, by extending the principle of geometrical optics applied to the conventional linear networks, each of the radiating elements is assigned the phase associated with the surface of the spherical wave going through this radiating element. Thus, the radiating elements $B_n (1 \leqq n \leqq N)$ will be subjected to this phase shift:

$$\phi_n = \frac{2\pi}{\lambda} \times \rho_n + 2k\pi$$

where $\rho_n$ is the distance from the point I to the radiating element $B_n$ considered and k is an integer.

In the case of conventional radiating networks, whether linear or plane, the Gaussian shape of the beam is preserved only for moderate beamwidth broadening values of the order of 2 to 3. This is also the case with volume arrays where the Gaussian shape can be preserved only for values of beamwidth broadening that are not excessively great. For greater values, just as in the case of linear arrays or plane arrays but not more than in the case of these arrays, the beam will have increasingly pronounced humps until it becomes shapeless.

Figure 3:
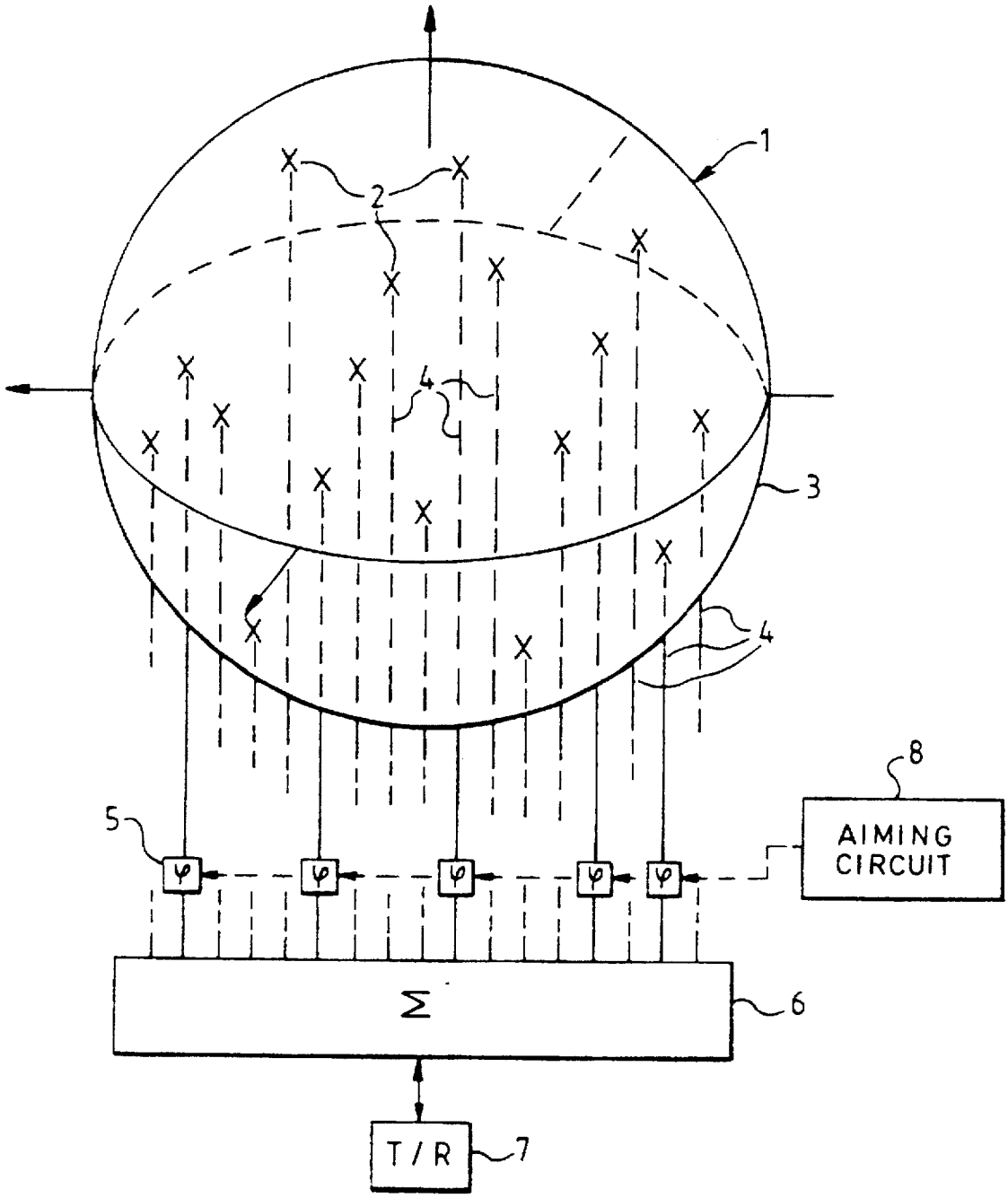
FIG. 3 gives a schematic view of a volume antenna transceiver device enabling the implementation of the beam broadening method according to the invention.

FIG. 3 shows the general configuration of a volume antenna transceiver device. The antenna proper is formed by an array 1 of radiating elements 2 distributed randomly and homogeneously within an enveloping volume 3 in accordance with the principle of random thinned arrays.

In the case of an array of radiating elements, it is well known that, in order to prevent the appearance of spurious array lobes in certain beam aiming angles, it is necessary to arrange the radiating elements in the array in a network with a spacing of less than $\lambda/2$, $\lambda$ being the wavelength of operation of the array. Since the aperture of the beam obtained is inversely proportional to the dimension of the array counted in terms of wavelength, this leads to envisaging large-sized solid arrays with a large number of radiating elements.

The thinning consists in eliminating a large number of radiating elements in a solid array. It provides for savings as regards the number of radiating elements for a given size of the array, namely for a given aperture of the beam, and also, if not the elimination, at least a major reduction of the couplings between radiating elements which are often the cause of the degradation of the performance values of the array antenna. The trade-off is that it gives rise to the appearance of array lobes.

The random feature enables a reduction of the array lobes inherent in wide-pitched even structures.

For the clarity of the drawing, the respective proportions between the length of the different radiating elements (in principle close to a half-wavelength), their relative spacing (of the order of several wavelengths), the diameter of the volume of the envelope (in the range of several tenths of a wavelength) have not been maintained. Furthermore, these various dimensions may vary in substantial proportions as a function of the desired performance characteristics (gain, thinness of the beam, etc.).

Each radiating element 2 is fed individually by a low loss vertical line 4 leading to an active module 5 of its own that comprises at least one individually controllable phase-shifter circuit but may also comprise amplifier, filtering and other circuits depending on the functions assumed by the antenna and the types of signals that it might have to transmit or receive.

The settings of the phase-shifter circuits of the active modules 5 enable the application, to the different radiating elements, of phase correction values resulting from an aiming phase excitation law determined as a function of the direction aimed at and, when the need for it is felt, the combination of this aiming phase excitation law with an additional beam broadening excitation law according to that described here above. This is done by means of an aiming circuit 8.

The different active modules 5 are connected to a distributor 6 which distributes or sums the signals coming from or intended for transmission and/or reception circuits 7.

All the above lines of reasoning have been developed with respect to both transmission and reception by applying the theorem of reciprocity.

The beam broadening method that has just been described can be applied to all types of volume arrays whether regular or non-regular, thinned or non-thinned, etc. The method can also be applied to so-called conformal arrays where the radiating elements are distributed on a curved surface (cylinder, cone, sphere, etc.).

What is claimed as new and desired to be secured by letters patent of the United States is:

1. A method for broadening the beam of a volume antenna having a set of n radiating elements, n being an integer greater than 1, said method comprising the following steps:

applying a phase excitation law to each of the n radiating elements; and assigning each of the n radiating elements a phase associated with a surface of a spherical wave passing through the volume antenna.

2. The method of claim 1, wherein the phase excitation law for each of the n radiating elements is represented by the equation $$2\frac{\pi}{\lambda}\rho_n + 2k\pi$$

wherein $\lambda$ is a wavelength of radiation transmitted or received, k is an integer, and $\rho_n$ is a distance from the nth radiating element to a point which is external to the volume antenna, located on a side of the antenna opposite an aiming direction, and located on an axis of the aiming direction.

* * * * *